US010874896B1

(12) United States Patent
Little

(10) Patent No.: US 10,874,896 B1
(45) Date of Patent: Dec. 29, 2020

(54) EXERCISER DEVICE

(71) Applicant: Anthony A. Little, Odessa, FL (US)

(72) Inventor: Anthony A. Little, Odessa, FL (US)

( * ) Notice: Subject to any disclaimer, the term of this patent is extended or adjusted under 35 U.S.C. 154(b) by 0 days.

(21) Appl. No.: 15/893,033

(22) Filed: Feb. 9, 2018

Related U.S. Application Data

(63) Continuation-in-part of application No. 29/529,495, filed on Jun. 8, 2015, now abandoned, which is a continuation-in-part of application No. 29/454,052, filed on May 6, 2013, now abandoned.

(51) Int. Cl.
*A63B 21/055* (2006.01)
*A63B 21/00* (2006.01)
*A63B 23/12* (2006.01)
*A63B 21/04* (2006.01)

(52) U.S. Cl.
CPC ..... *A63B 21/0557* (2013.01); *A63B 21/0442* (2013.01); *A63B 21/4035* (2015.10); *A63B 23/12* (2013.01)

(58) Field of Classification Search
CPC ..... A63B 21/02–0557; A63B 21/4035
See application file for complete search history.

(56) References Cited

U.S. PATENT DOCUMENTS 2,722,419 A * 11/1955 Tarapczynski ..... A63B 21/0724 482/106
4,440,391 A * 4/1984 Saenz, Jr. ..... A63B 21/0004 403/296
4,518,162 A * 5/1985 Oates ..... A63B 21/072 403/349
D290,485 S * 6/1987 Suponitsky ..... D21/679
4,770,414 A * 9/1988 Fredrickson ..... A63B 23/0211 482/148
5,312,314 A * 5/1994 Stephan ..... A63B 21/0602 482/106
5,967,952 A * 10/1999 Bronstein ..... A63B 21/0602 482/105
6,126,581 A * 10/2000 Hartsel ..... A63B 21/0004 482/140
D464,691 S * 10/2002 Tracy ..... D21/679
6,599,222 B2 * 7/2003 Wince ..... A63B 21/0724 482/106
7,681,766 B2 * 3/2010 Harrison, III ..... A45F 3/10 224/265
8,047,974 B1 * 11/2011 Kanelos ..... A63B 21/0724 482/106
D657,010 S * 4/2012 Cen ..... D21/679
8,821,356 B2 * 9/2014 Burke ..... A63B 21/075 482/92

(Continued)

*Primary Examiner* — Jennifer Robertson
(74) *Attorney, Agent, or Firm* — Blank Rome LLP

(57) ABSTRACT

Left and right handle segments each have an interior end and an exterior end and have a central handle segment with a left end and a right end. Left and right resistance bands each have an upper end with an upper enlargement and a lower end with a lower enlargement. Left and right coupling components are each coupled to an associated handle segment and to an associated resistance band respectively. Left and right foot straps each have a grommet above and a large loop with a slidable sleeve below. Each grommet supports an associated lower enlargement. Each slidable sleeve is adapted to receive a user's foot. A slider on each lower loop adjusts the size of the lower loop.

11 Claims, 18 Drawing Sheets

(56) References Cited

U.S. PATENT DOCUMENTS

| | | | | |
|---|---|---|---|---|
| 9,044,373 | B2 * | 6/2015 | Welch | A63B 21/0724 |
| 9,821,185 | B2 * | 11/2017 | Welch | A63B 21/0724 |
| 10,220,236 | B2 * | 3/2019 | Oltorik, Jr. | A63B 21/0442 |
| 2005/0137066 | A1 * | 6/2005 | Wu | A63B 21/0004 482/126 |
| 2006/0052223 | A1 * | 3/2006 | Terry | A63B 21/0004 482/126 |
| 2007/0042881 | A1 * | 2/2007 | Wu | A63B 21/0004 482/126 |
| 2011/0251033 | A1 * | 10/2011 | Blancher | A63B 22/16 482/123 |

* cited by examiner

EXERCISER DEVICE

RELATED APPLICATION

The present application is a continuation-in-part of pending application Ser. No. 29/529,495 filed Jun. 8, 2015, the priority of which is hereby claimed and the subject matter of which is incorporated herein by reference.

BACKGROUND OF THE INVENTION

Field of the Invention

The present invention relates to an exerciser device for total body exercise, both aerobic and anaerobic, and cardio and muscle toning.

Description of the Prior Art

The use of exerciser devices of known designs and configurations is known in the prior art. More specifically, exerciser devices of known designs and configurations previously devised and utilized for the purpose of aerobic, anaerobic, cardio and muscle toning exercising are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an exerciser device for total body exercise, both aerobic and anaerobic, and cardio and muscle toning.

In this respect, the exerciser device according to the present invention substantially departs from the conventional concepts and designs of the prior art, and in doing so provides an apparatus primarily developed for total body exercise, both aerobic and anaerobic, and cardio and muscle toning.

Therefore, it can be appreciated that there exists a continuing need for a new and improved exerciser device which can be used for total body exercise, both aerobic and anaerobic, and cardio and muscle toning. In this regard, the present invention substantially fulfills this need.

SUMMARY OF THE INVENTION

In view of the disadvantages inherent in the known types of exerciser devices of known designs and configurations now present in the prior art, the present invention provides an improved exerciser device. As such, the general purpose of the present invention, which will be described subsequently in greater detail, is to provide a new and improved exerciser device and method which has all the advantages of the prior art and none of the disadvantages.

To attain this, from a broad perspective, the present invention essentially comprises left and right handle segments each having an interior end and an exterior end and having a central handle segment with a left end and a right end. Left and right resistance bands each have an upper end with an upper enlargement and a lower end with a lower enlargement. Left and right coupling components are each coupled to an associated handle segment and to an associated resistance band respectively. Left and right foot straps each have a grommet above and a large loop with a slidable sleeve below. Each grommet supports an associated lower enlargement, each slidable sleeve is adapted to receive a user's foot. A slider on each lower loop adjusts the size of the lower loop. There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exerciser device which has all of the advantages of the prior art exerciser devices of known designs and configurations and none of the disadvantages.

It is another object of the present invention to provide a new and improved exerciser device which may be easily and efficiently manufactured and marketed.

It is a further object of the present invention to provide a new and improved exerciser device which is of durable and reliable constructions.

An even further object of the present invention is to provide a new and improved exerciser device which is susceptible of a low cost of manufacture with regard to both materials and labor, and which accordingly is then susceptible of low prices of sale to the consuming public, thereby making such exerciser device economically available to the buying public.

Lastly, it is an object of the present invention to provide an exerciser device for total body exercise, both aerobic and anaerobic, and cardio and muscle toning.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1A:
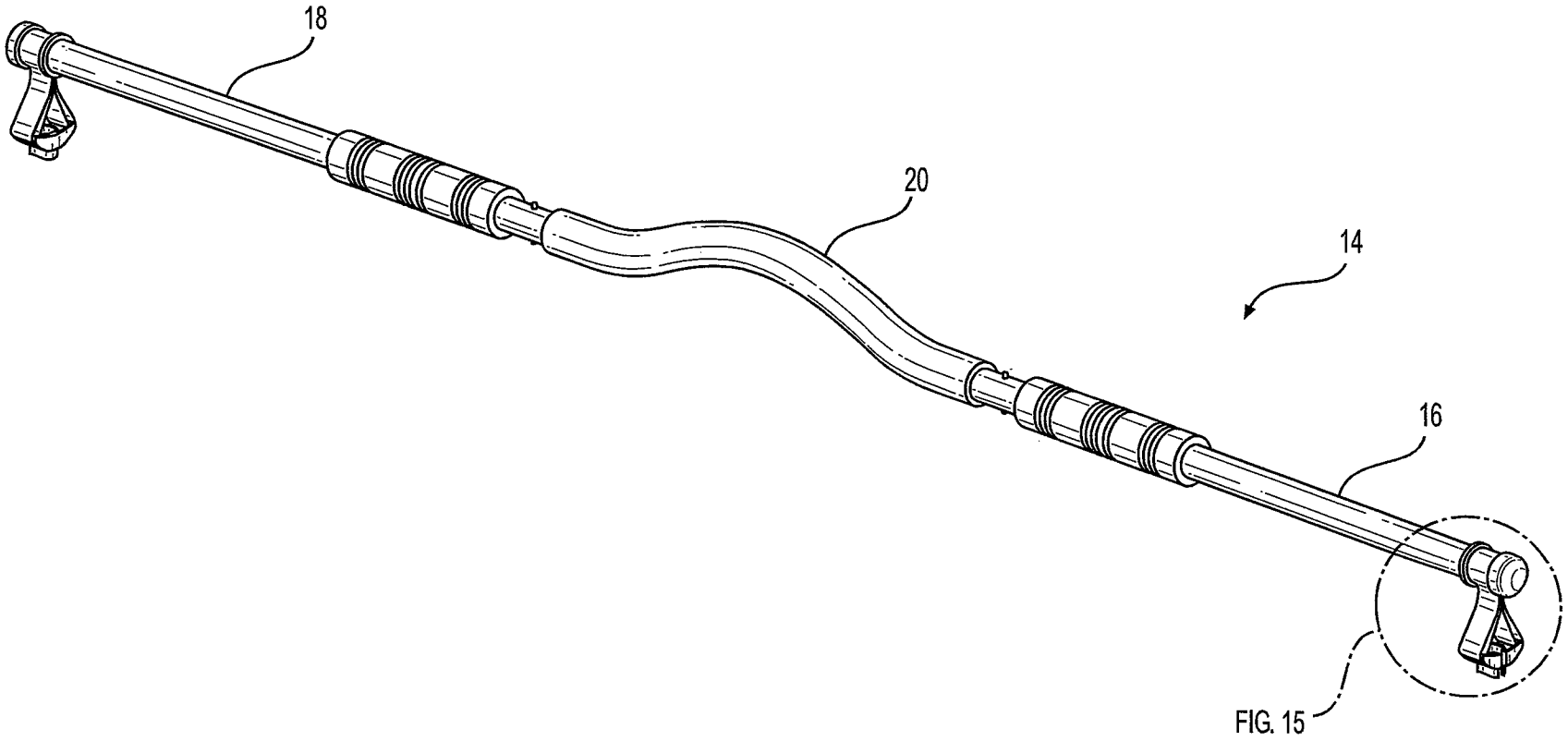
FIG. 1A is a perspective illustration of upper components of an exerciser device constructed in accordance with the principles of the present invention.
Figure 1B:
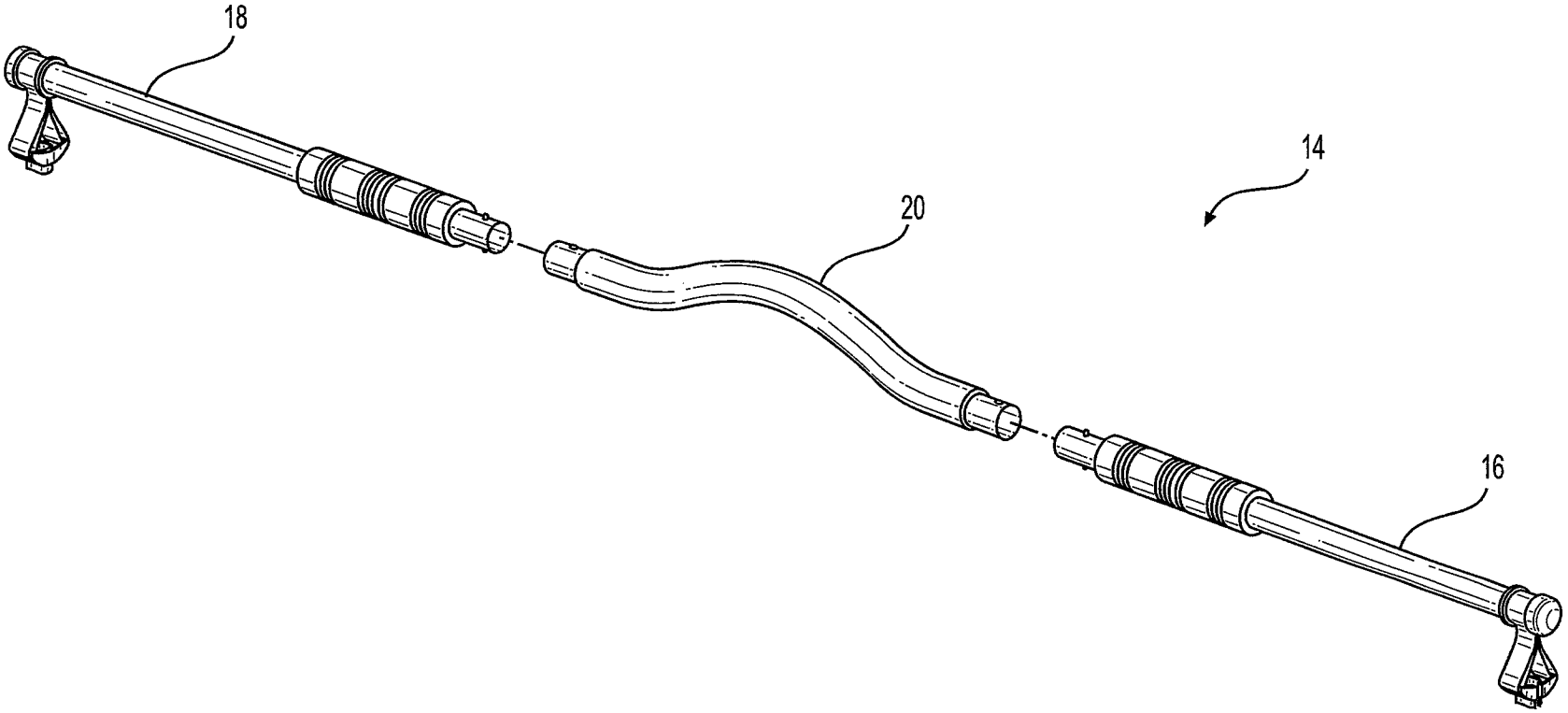
FIG. 1B is a perspective illustration of upper components of an exerciser device similar to FIG. 1A but with the upper components separated.
Figure 2:
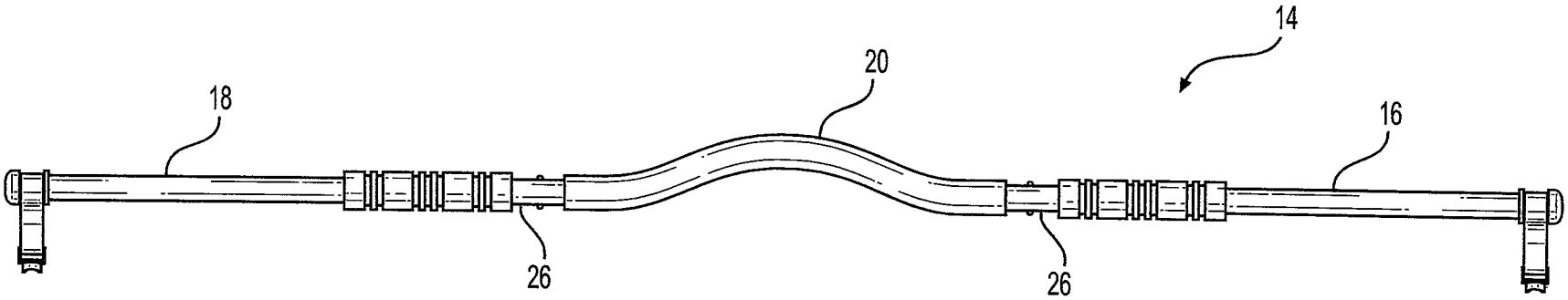
FIG. 2 is a front elevational view of the upper components of the exerciser device shown in FIG. 1.
Figure 3:
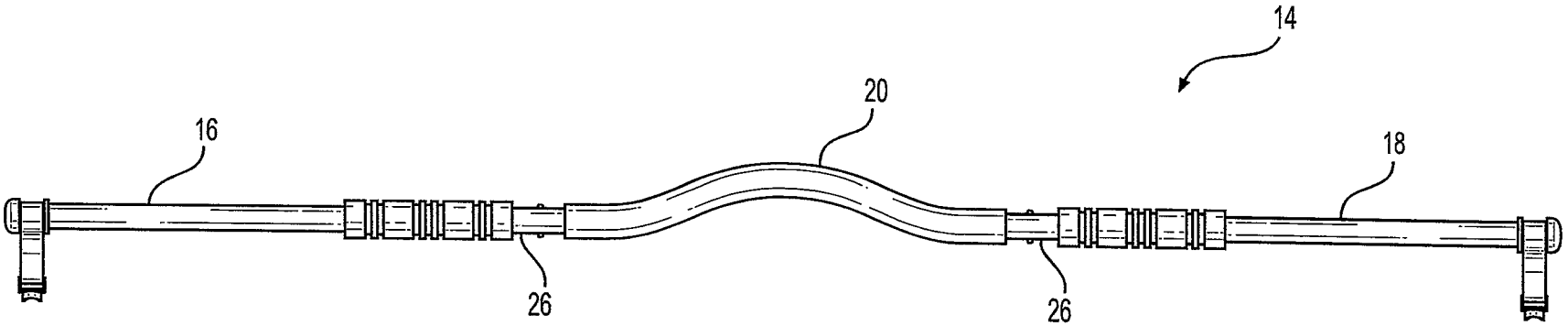
FIG. 3 is a rear elevational view of the upper components of the exerciser device shown in FIG. 1.
Figure 5:
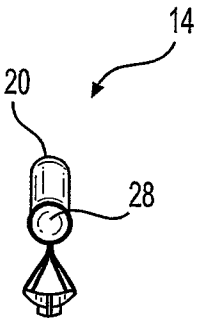
FIG. 5 is a right end elevational view of the components shown in FIG. 2.
Figure 4:
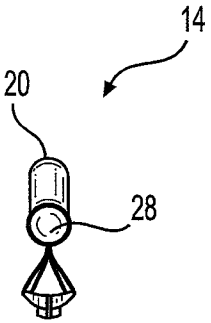
FIG. 4 is a left end elevational view of the components shown in FIG. 2.
Figure 6:
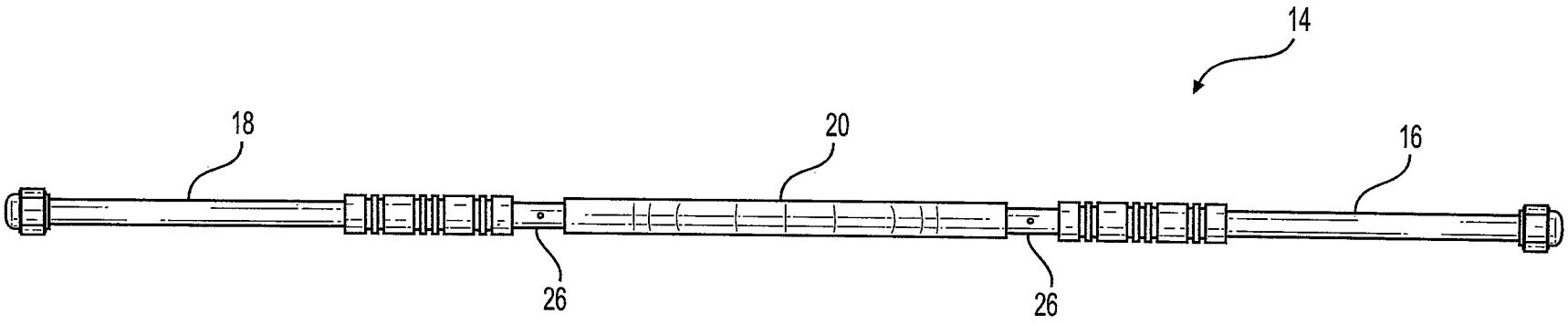
FIG. 6 is a plan view of the components shown in FIGS. 2 and 3.
Figure 7:
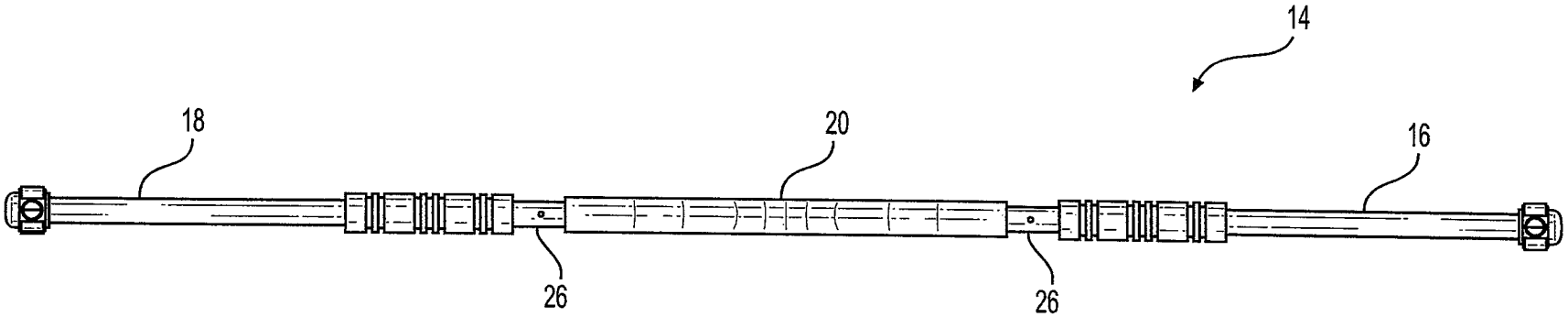
FIG. 7 is a bottom view of the components shown in FIGS. 2 and 3.
Figure 8:
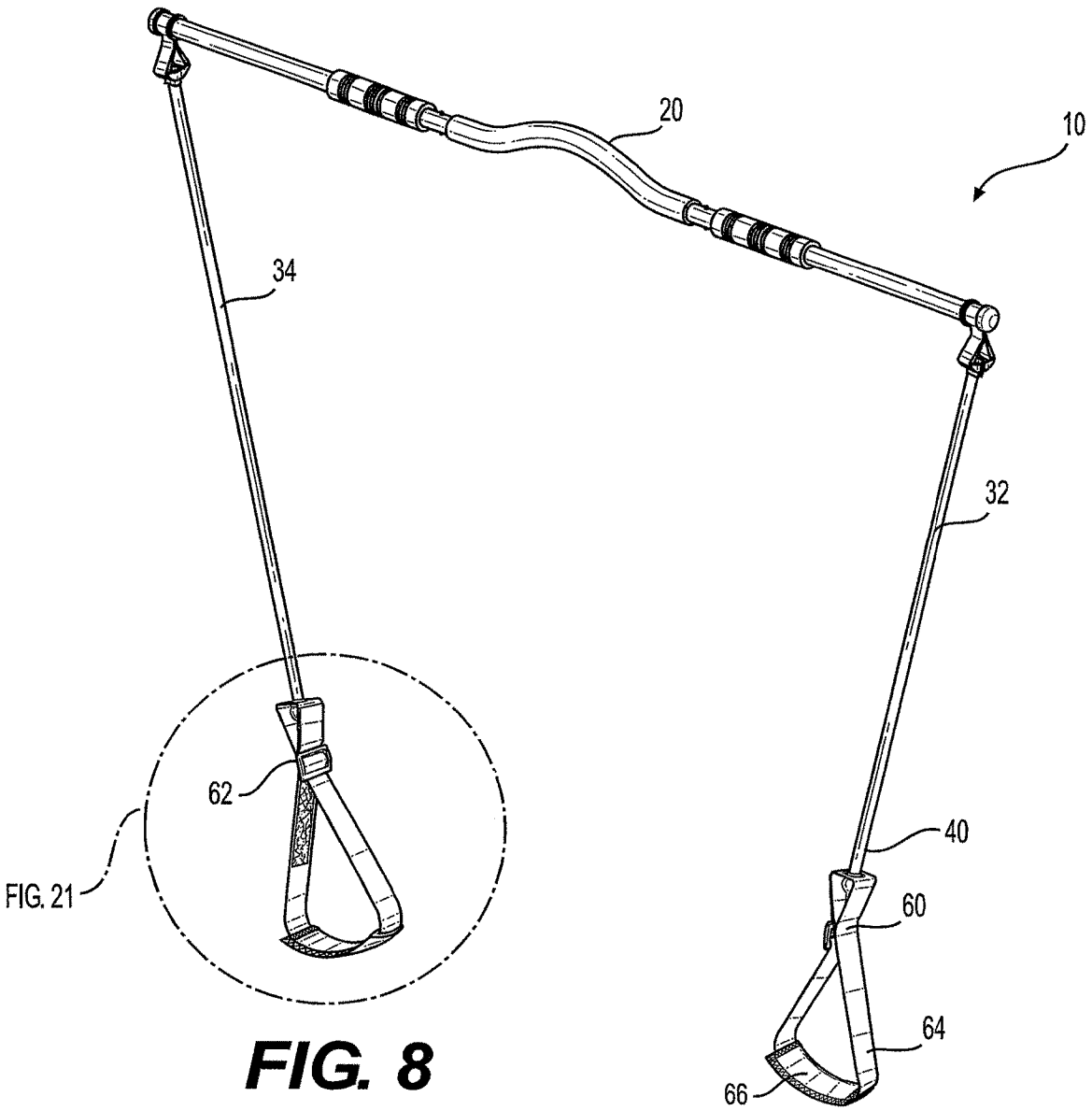
FIG. 8 is a perspective illustration of an exerciser device constructed in accordance with the principles of the present invention.
Figure 9:
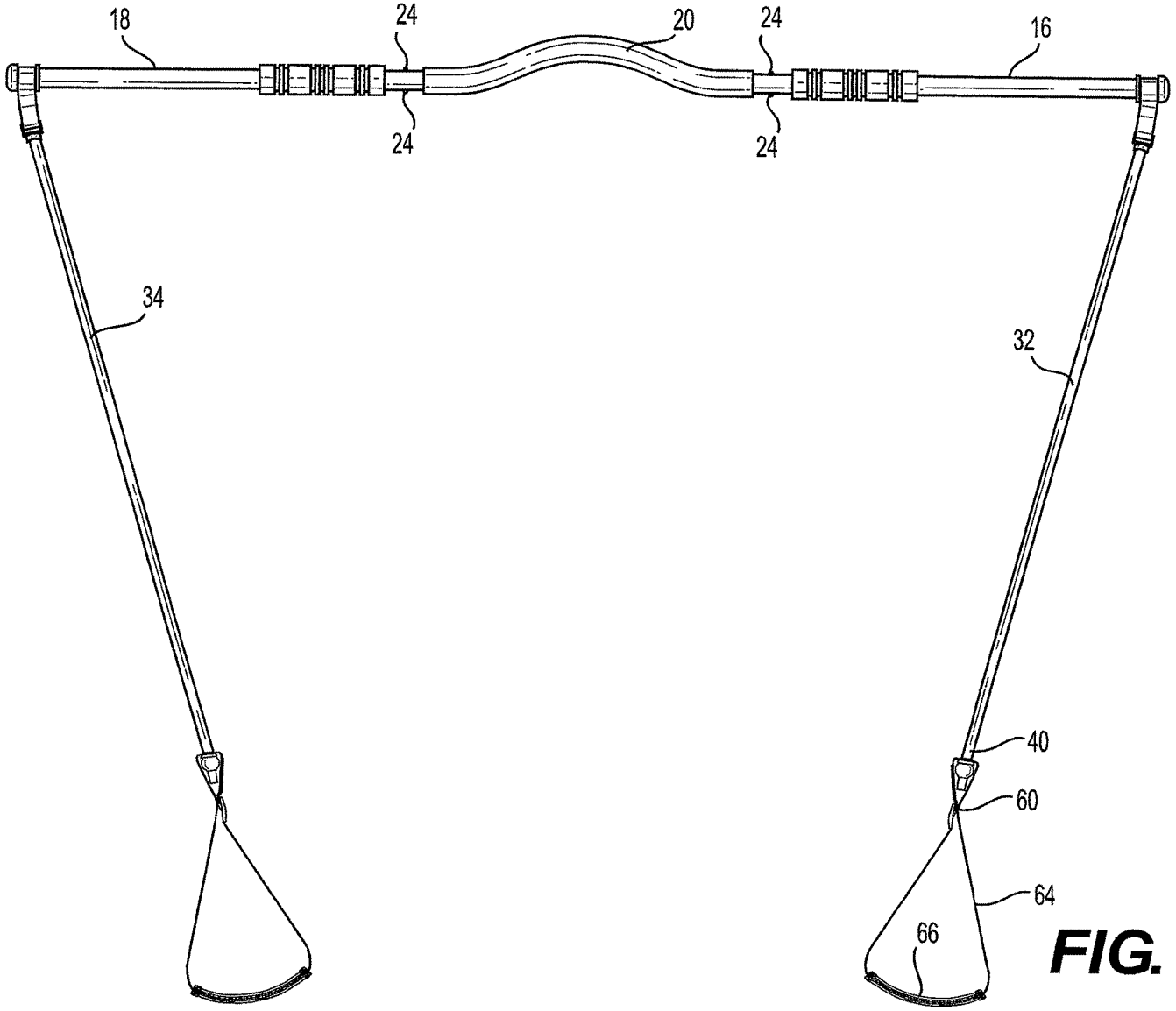
FIG. 9 is a front elevational view of the exerciser device shown in FIG. 8.
Figure 10:
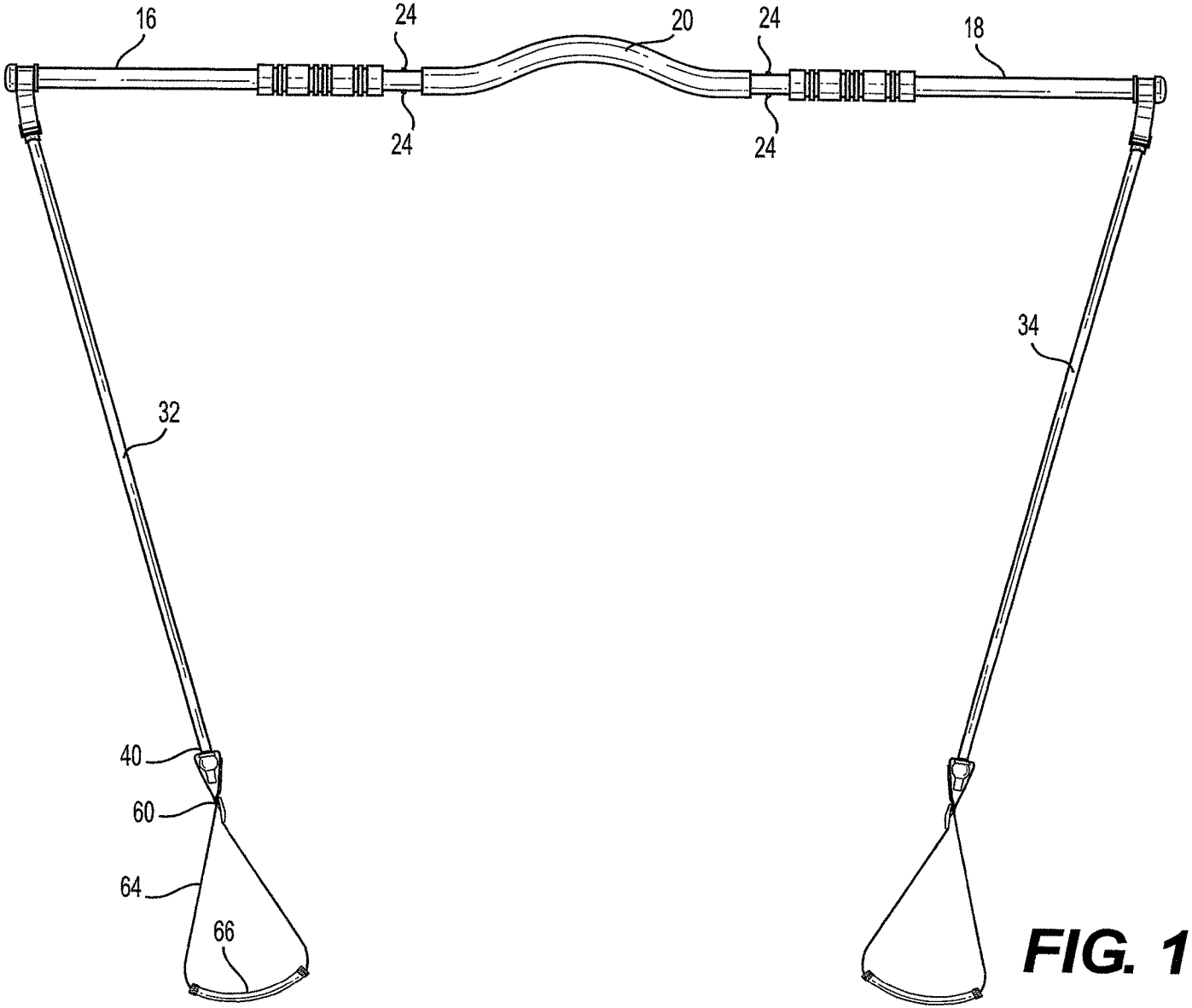
FIG. 10 is a rear elevational view of the exerciser device shown in FIG. 8.
Figure 12:
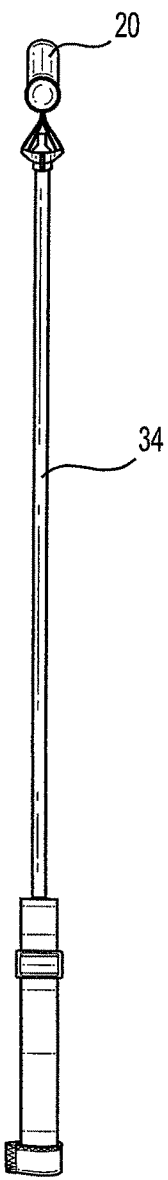
FIG. 12 is a right end elevational view of the exerciser device shown in FIG. 8.
Figure 11:
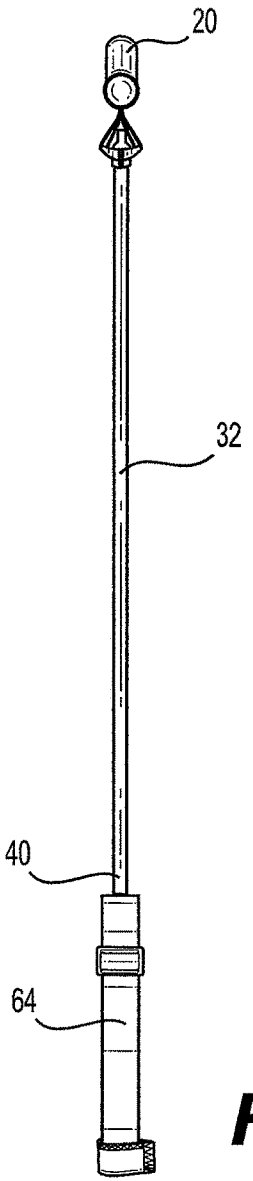
FIG. 11 is a left end elevational view of the exerciser device shown in FIG. 8.

With reference now to the drawings, and in particular to FIG. 1 thereof, the preferred embodiment of the new and improved exerciser device embodying the principles and concepts of the present invention and generally designated by the reference numeral 10 will be described.

The present invention, the exerciser device 10 is comprised of a plurality of components. Such components in their broadest context include left and right handle segments, left and right resistance bands, left and right coupling components, and left and right foot straps. Such components are individually configured and correlated with respect to each other so as to attain the desired objective.

From a specific perspective, the invention of the present application is an exerciser device 10 for total body exercise, both aerobic and anaerobic, cardio and muscle toning. First provided in the preferred embodiment is a handle assembly 14. The handle assembly includes a left handle segment 16 with an interior end and an exterior end. The handle assembly also includes a right handle segment 18 with an interior end and an exterior end. The handle assembly also includes a central handle segment 20' with a left end and a right end. A foam grip 22 is provided on the left handle segment and a foam grip 22 is provided on the right handle segment. Two spring urged buttons 24 are provided adjacent to the interior ends of the left handle segment and the right handle segment. Two apertures 26 are provided adjacent to the left and right ends of the central handle segments to receive the spring urged buttons. The two buttons of each handle segment are rotationally spaced by 180 degrees. The two apertures of each handle segment are rotationally spaced by 180 degrees to insure rotational orientation between central and right and left handle segments. Spaced annular projections 28 are provided adjacent to the exterior end of the exterior end of the left and right handle segments.

Next, a first left resistance band 32 and a first right resistance band 34, are provided. The first resistance bands are of a first strength and color. A second left resistance band 32 and a second right resistance band 34 are also provided. The second resistance bands are of a second stronger strength and a second color. The user begins using the exerciser device with the first resistance bands and then graduates to the second resistance bands as the user adapts to the exerciser device and becomes stronger. The second resistance bands are then used in place of the first resistance bands to provide the user with increased resistance and exercise. Each resistance band has an upper end 36 with an upper enlargement 38 there adjacent. Each resistance band has a lower end 40 with a lower enlargement 42 there adjacent. a left resistance band (32) of a first strength and a first color and a right resistance band (34) of the first strength and the first color, a second left resistance band (32) of a second strength and a second color and a second right resistance band of the second strength (34) the second color, A left coupling component 44 and a right coupling component 46 are next provided. Each coupling component is formed of a flexible major loop with stitching 48 dividing each major loop into a small loop 50 above and a large loop 52 below. Each large loop supports a rigid plastic plate 54 with a recess 56. Each recess removably receives an upper enlargement of an associated resistance band.

Next provided are a left foot strap 60 and a right foot strap 62. Each foot strap is in a small loop 64 with a grommet 66 above and a large loop 68 with a slidable sleeve 70 below. Each grommet supports an associated lower enlargement of each resistance band. Each slidable sleeve is adapted to receive a foot of a user. A slider 72 is provided on each lower loop for adjustment of the size of the lower loop.

The slidable sleeve of each foot strap is movable between a first orientation and a second orientation. In the first orientation the slidable sleeves are adjacent to the resistance bands and the feet of the user are positioned in the large loops. In the second orientation, the slidable sleeves are remote from the resistance bands and the hands of the user are positioned in the large loops grasping the slidable sleeves. This ability to reposition the invention in both orientations allows a full body workout exercising both the upper and lower body.

In the preferred embodiment of the invention, the central handle segment 20 is curved. Note FIG. 1A.

Figure 13A:
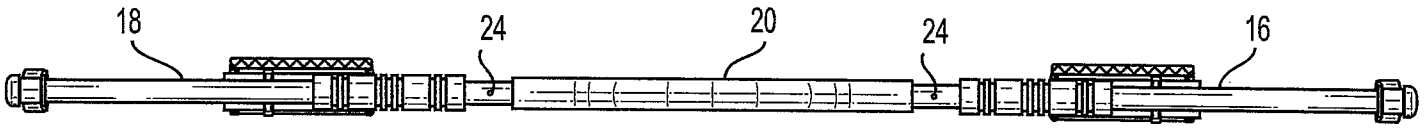
FIG. 13A is a plan view of the exerciser device shown in FIGS. 9 and 10.
Figure 13B:
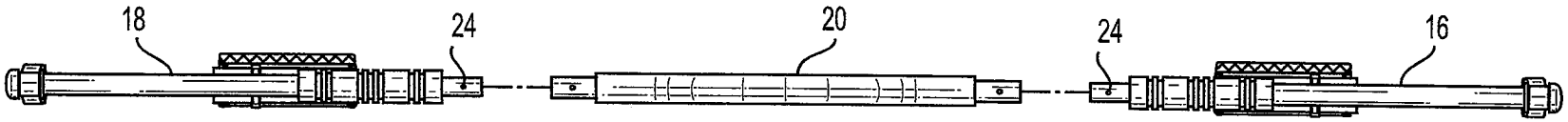
FIG. 13B is plan view of the exerciser device similar to FIG. 13A but with the upper components separated.
Figure 14:
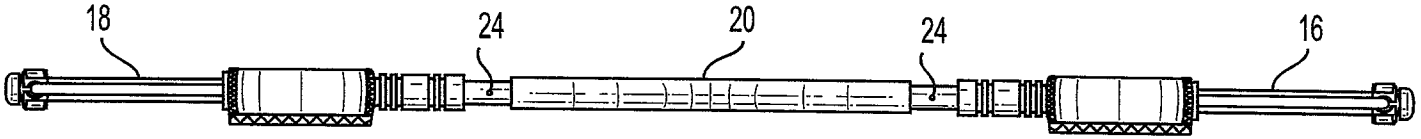
FIG. 14 is a bottom view of the exerciser device shown in FIGS. 9 and 10.
Figure 15:
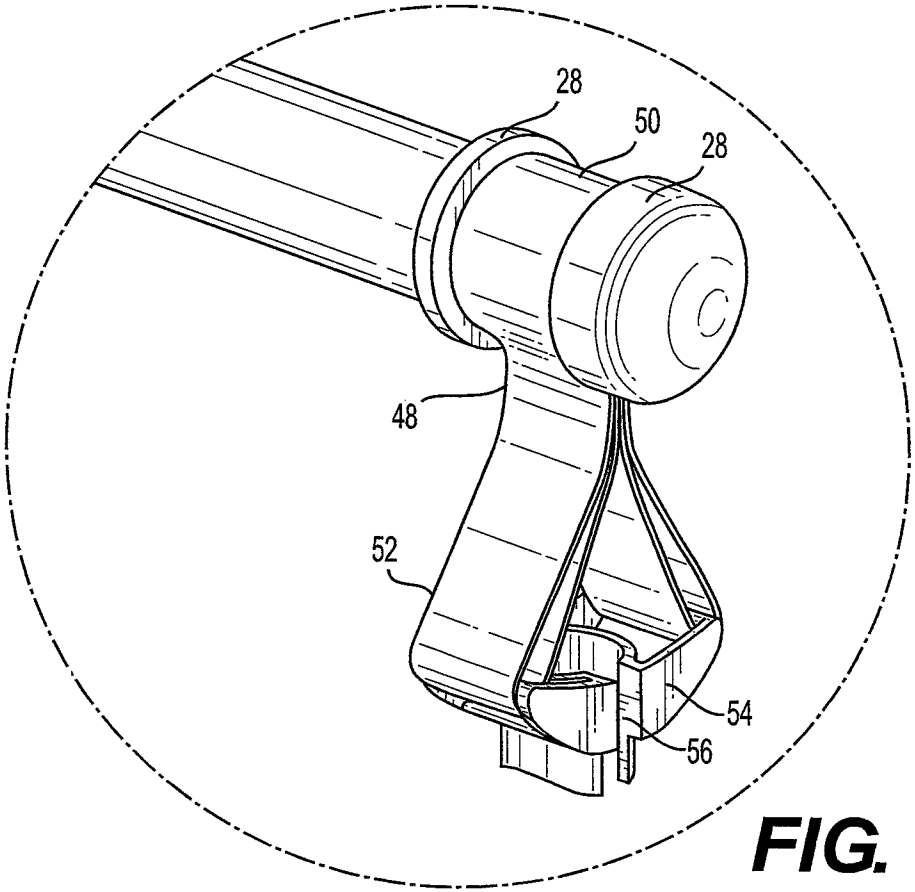
FIG. 15 is an enlarged showing of the components illustrated in circle 15 of FIG. 1.

In another embodiment, the central handle segment is linear 76. Note FIG. 13A.

Figure 16:
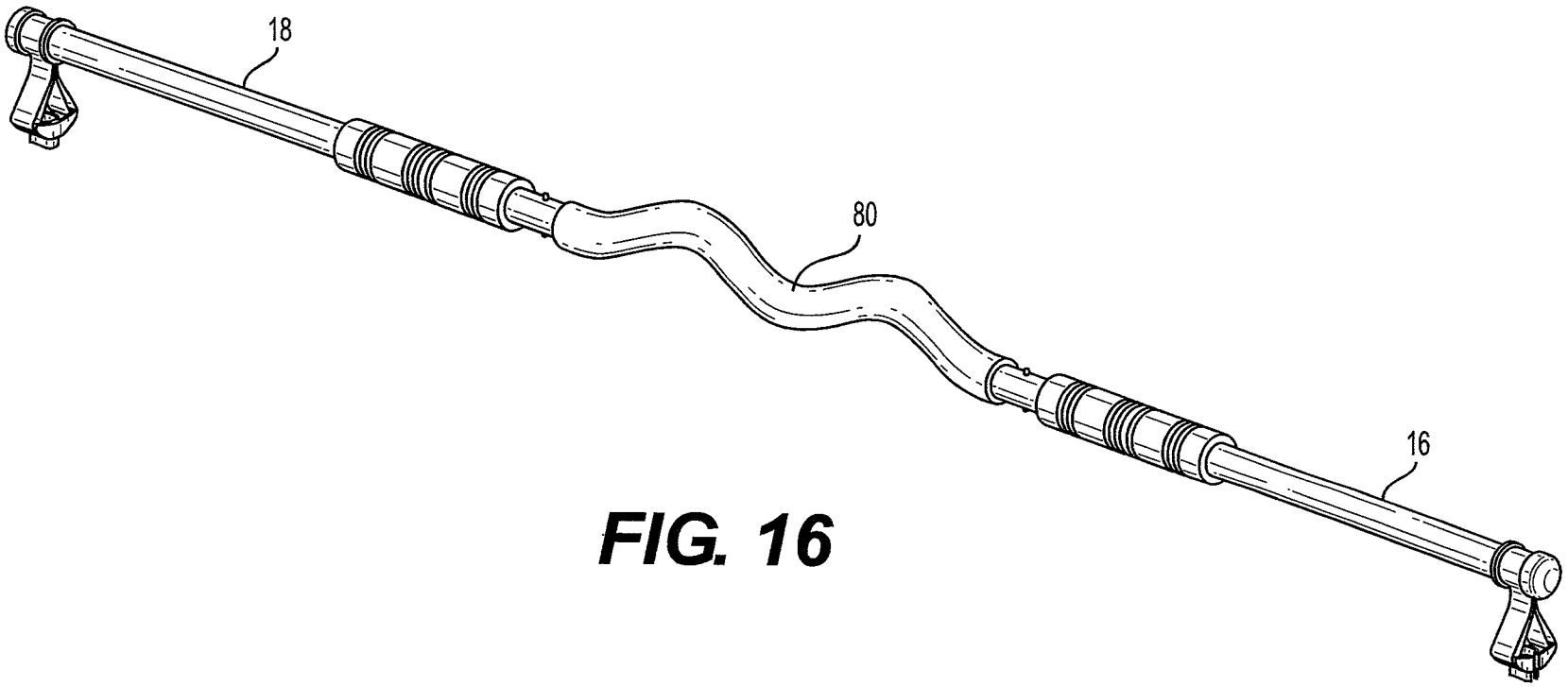
FIG. 16 is a perspective illustration of a central handle segment showing a first embodiment of the invention.
Figure 17:
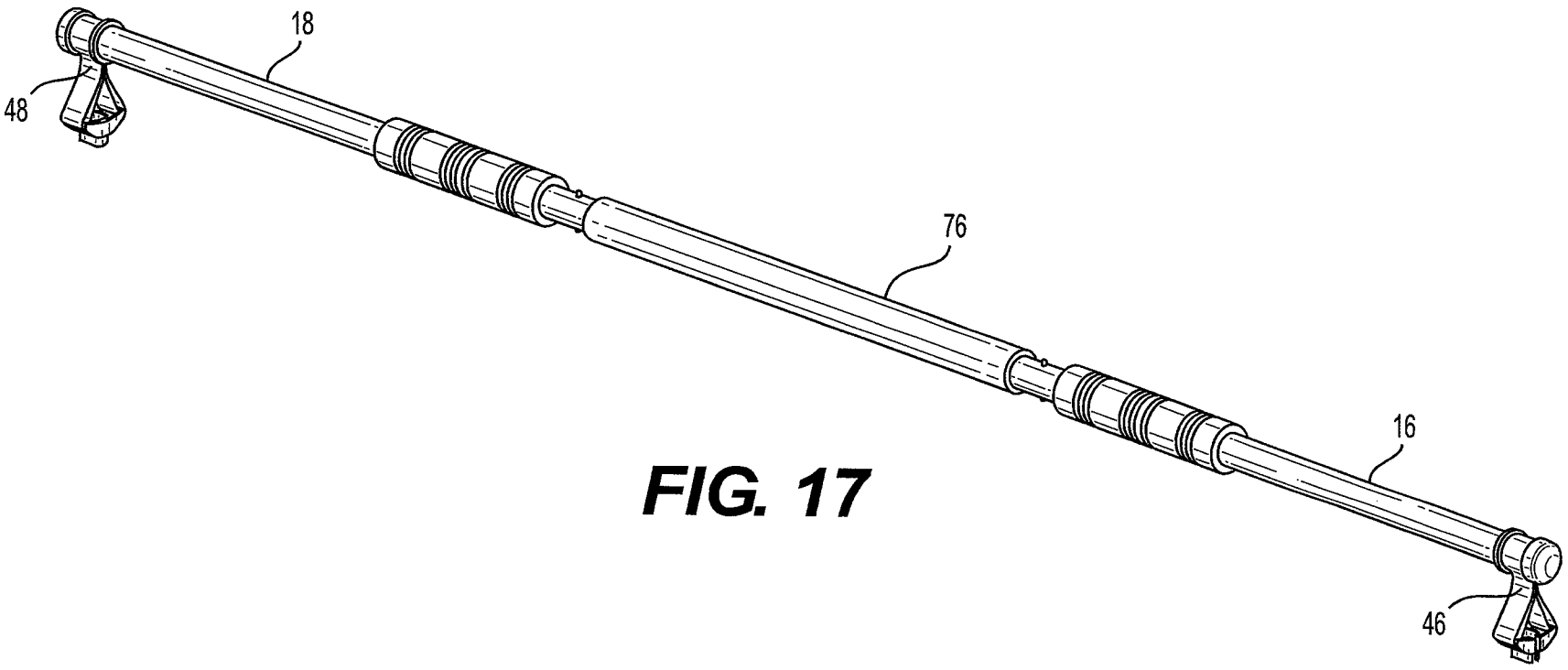
FIG. 17 is a perspective illustration of a central handle segment showing a second embodiment of the invention.
Figure 18:
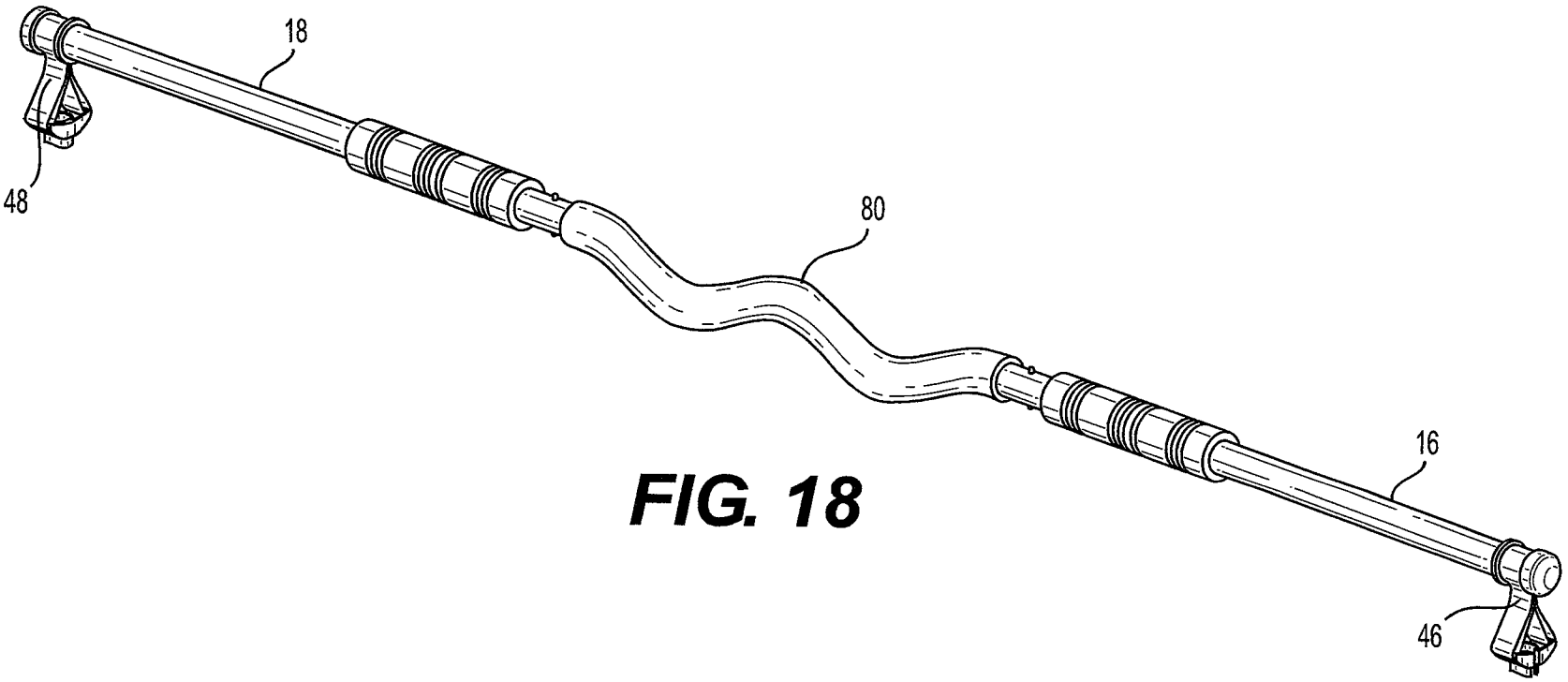
FIG. 18 is a perspective illustration of a central handle segment showing a third embodiment of the invention.
Figure 19:
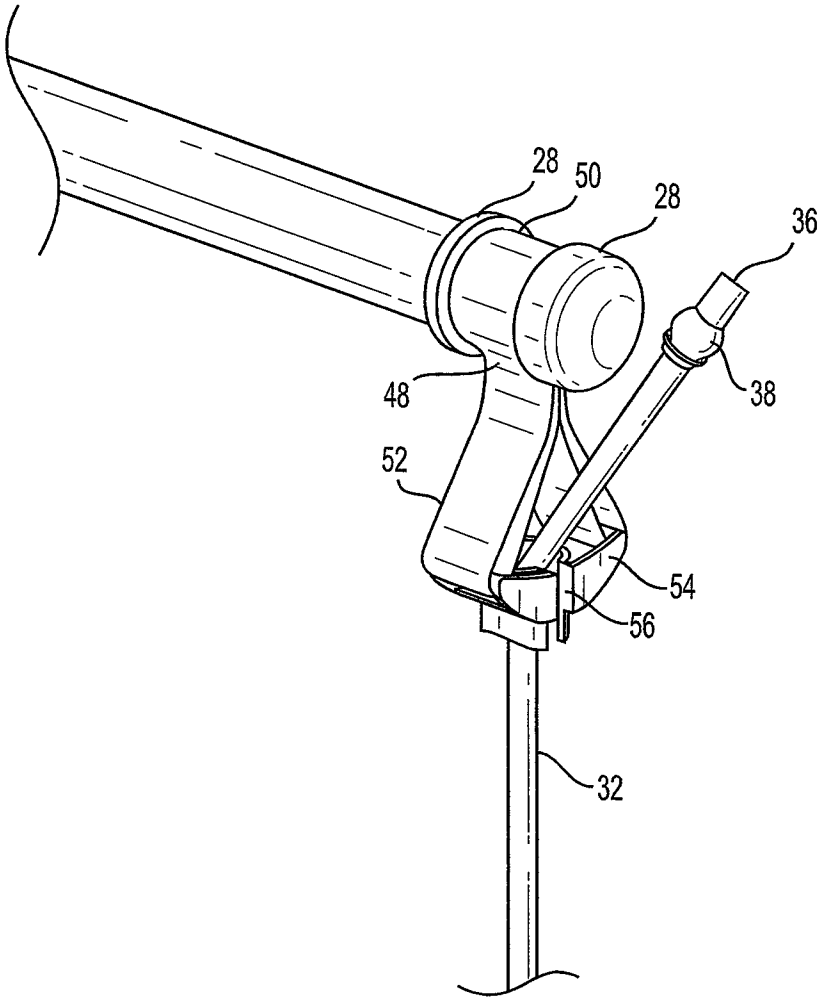
FIG. 19 is a perspective illustration similar to FIG. 15 but with a resistance band partially inserted.
Figure 20:
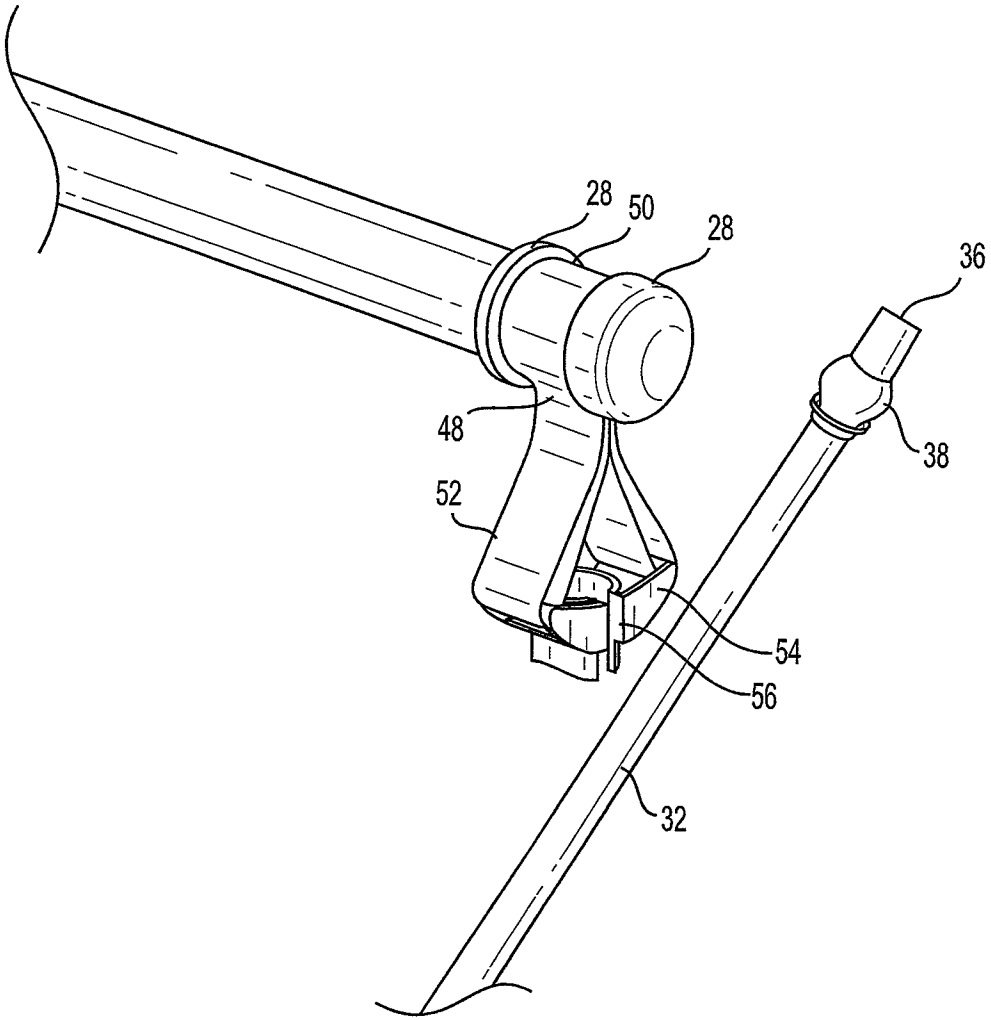
FIG. 20 is a perspective illustration similar to FIG. 15 but with a resistance band shown prior to being inserted.
Figure 21:
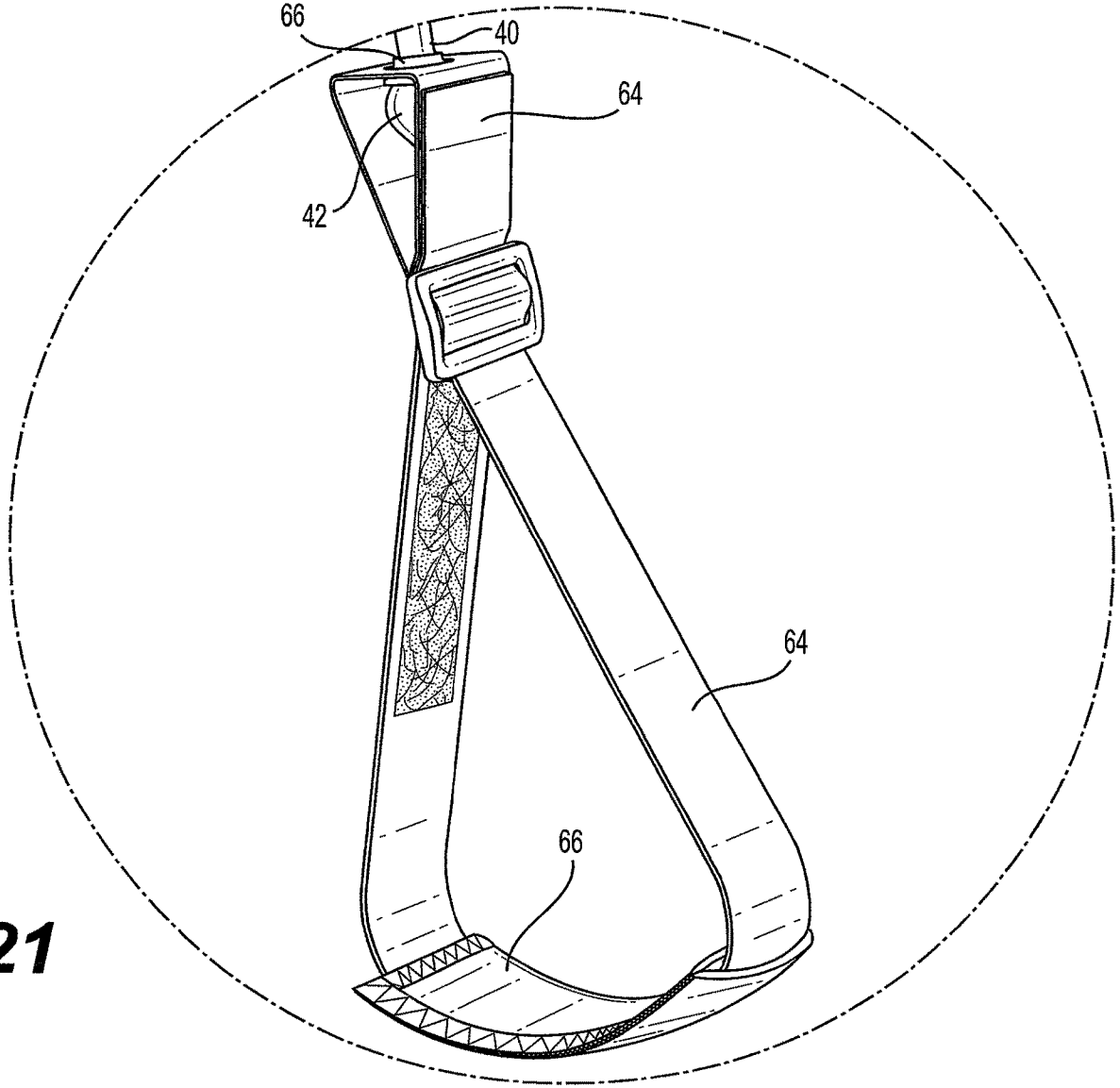
FIG. 21 is an enlarged perspective illustration of a foot strap.

In still another embodiment, the central handle segment 80 is M-shaped. Note FIGS. 16 and 18.

In another embodiment, the slidable sleeve has a length less than 50 percent of the length of the large loop.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exerciser device comprising:

left and right handle segments, each handle segment having an interior end and an exterior end, and a central handle segment therebetween with a left end and a right end;

left and right resistance bands, each resistance band having an upper end with an upper enlargement, each resistance band having a lower end with a lower enlargement;

left and right coupling components, each coupling component respectively coupled to an associated left or right handle segment and respectively to an associated resistance band, wherein each coupling component is formed of a small loop above, configured for attachment to the exterior end of the left or the right handle segment, and two large loops below, where each large loop has a proximal end, adjacent to the small loop, and a distal end attached to, and supporting, an end of a rigid plate, where the rigid plate spans between the distal ends of the large loops, and includes a recess therein configured to accept, between the two large loops, the upper enlargement of the left or the right resistance band, where a perimeter of the recess includes a slot, over an entirety of a depth of the recess, to provide acceptance and removal of the upper enlargement, without mechanical latching, while securing the upper enlargement therein for use; and left and right foot or hand straps, each foot or hand strap having a small loop above with a connector, and a large loop below, each connector supporting an associated lower enlargement, each large loop adapted to receive a foot or hand of the user, and a slider associated with each large loop for adjustment of the size of the large loop.

2. The system as set forth in claim 1 wherein the foot or hand straps each further include a slidable sleeve around the large loop:

the slidable sleeve has a length less than 50 percent of the length of the large loop; and the slidable sleeve of each foot or hand strap is movable between a first orientation and a second orientation, the first orientation being with the slidable sleeve adjacent to the resistance band, configured for placement of a foot of the user in the large loop, the second orientation being with the slidable sleeve remote from the resistance band, configured for placement of a hand of the user in the large loop grasping the slidable sleeve.

3. The exercise device as set forth in claim 1 wherein the central handle segment (20) is curved.

4. The exercise device as set forth in claim 1 wherein the central handle segment (76) is linear.

5. The exercise device as set forth in claim 1 wherein the central handle segment (80) is M-shaped.

6. The exerciser device as set forth in claim 1 and further including:

two spring urged buttons (24) adjacent to the interior end of the left handle segment and two spring urged buttons (24) adjacent to the interior end of the right handle segment, two apertures (26) adjacent to the left end of the central handle segment and two apertures (26) adjacent to the right end of the central handle segment to receive the spring urged buttons, the two buttons of each handle segment being rotationally spaced by 180 degrees, the two apertures of each handle segment rotationally spaced by 180 degrees to insure rotational orientation between central and right and left handle segments, spaced annular projections (28) adjacent to the exterior end of the left and right handle segments.

7. The exerciser device as set forth in claim 1, wherein each coupling component is formed of a flexible material with stitching dividing the small loop above and two large loops below, the stitching configured to facilitate attachment of the small loop to the exterior end of the left or the right handle segment.

8. The exerciser device as set forth in claim 1, wherein the upper enlargement is bulbous, with spherical shape, the recess has a circular perimeter, configured to accept the bulbous, spherical upper enlargement, and the slot is of a width just larger than thickness or diameter of the resistance band, facilitating acceptance of the upper enlargement within the recess, from between the two large loops.

9. The exerciser device as set forth in claim 1, further comprising, in combination, a second left and a second right resistance band, each of the second left and right resistance bands having an upper end with an upper enlargement and a lower end with a lower enlargement, wherein the first left and right resistance bands have a first resistance and a first color and the second left and right resistance bands have a second resistance and a second color, the second resistance being greater than the first resistance, each of the first left and right resistance bands, and the second left and right resistance bands, being configured for coupling to the left and the right coupling components.

10. An exerciser device comprising:

left and right handle segments, each handle segment having an interior end and an exterior end, and a central handle segment therebetween;

left and right resistance bands, each resistance band having an upper end and a lower end;

left and right coupling components, each coupling component respectively coupled to an associated left or right handle segment and respectively to an associated resistance band, wherein each coupling component is formed of a flexible major loop with stitching dividing each major loop into a small loop above, configured for attachment to the exterior end of the left or the right handle segment, and a two portion large loop below, each large loop supporting a rigid plate with a recess, each recess removably receiving the upper end of an associated resistance band; and left and right foot or hand straps, each foot or hand strap having a small loop above with a connector, and a large loop below, each connector supporting the lower end of an associated resistance band, each large loop adapted to receive a foot or hand of the user.

11. An exerciser device (10) for total body exercise, both aerobic and anaerobic, cardio and muscle toning, the exercise device comprising, in combination:

a handle assembly (14) including a left handle segment (16) with an interior end and an exterior end, a right handle segment (18) with an interior end and an exterior end, a central handle segment (20) with a left end and a right end, a foam grip (22) on the left handle segment and a foam grip (22) on the right handle segment, two spring urged buttons (24) adjacent to the interior end of the left handle segment and two spring urged buttons (24) adjacent to the interior end of the right handle segment, two apertures (26) adjacent to the left end of the central handle segment and two apertures (26) adjacent to the right end of the central handle segment to receive the spring urged buttons, the two buttons of each handle segment being rotationally spaced by 180 degrees, the two apertures of each handle segment rotationally spaced by 180 degrees to insure rotational orientation between central and right and left handle segments, spaced annular projections (28) adjacent to the exterior end of the left handle segment and the exterior end of the right handle segment;

a left resistance band (32) of a first strength and a first color and a right resistance band (34) of the first strength and the first color, a second left resistance band (32) of a second strength and a second color and a second right resistance band of the second strength (34) and the second color, the second strength being greater than the first strength, each resistance band having an upper end (36) with an upper enlargement (38) there adjacent, each resistance band having a lower end (40) with a lower enlargement (42) there adjacent;

a left coupling component (44) and a right coupling component (46), each coupling component formed of a flexible major loop with stitching (48) dividing each major loop into a small loop (50) above and a large loop (52) below, each large loop supporting a rigid plastic plate (54) with a recess (56), each recess removably receiving the upper enlargement of an associated resistance band; and a left foot strap (60) and a right foot strap (62), each foot strap including a small loop (64) with a grommet (66) above and a large loop (68) with a slidable sleeve (70) below, each grommet supporting an associated lower enlargement of each resistance band, each slidable sleeve adapted to receive a foot of a user, and a slider (72) associated with each large loop for adjustment of the size of the large loop.

* * * * *